United States Patent [19]

Takano et al.

[11] 4,450,813

[45] May 29, 1984

[54] DISTRIBUTION TYPE FUEL INJECTION PUMP

[75] Inventors: Yoshiya Takano, Katsuta; Yoshikazu Hoshi, Tohkai, both of Japan

[73] Assignee: Hitachi, Ltd., Tokyo, Japan

[21] Appl. No.: 409,558

[22] Filed: Aug. 19, 1982

[30] Foreign Application Priority Data

Aug. 28, 1981 [JP] Japan ..... 56-134117

[51] Int. Cl.[3] ..... F02M 59/20

[52] U.S. Cl. ..... 123/450; 123/500; 417/462; 417/386

[58] Field of Search ..... 123/450, 501, 502, 500, 123/357; 417/462, 386

[56] References Cited

U.S. PATENT DOCUMENTS

| | | | |
|---|---|---|---|
| 3,025,797 | 3/1962 | Hutcheon | 417/462 |
| 3,035,523 | 5/1962 | Kemp et al. | 417/386 |
| 3,107,661 | 10/1963 | Kemp | 417/462 |
| 3,263,614 | 8/1966 | Kemp | 417/386 |
| 3,500,749 | 3/1970 | Kemp et al. | 417/386 |
| 3,506,381 | 4/1970 | Kemp | 123/450 |
| 4,185,779 | 1/1980 | Watson | 123/472 |

FOREIGN PATENT DOCUMENTS

| | | | |
|---|---|---|---|
| 246055 | 12/1960 | Australia | 123/450 |

*Primary Examiner*—Ira S. Lazarus
*Assistant Examiner*—Magdalen Moy
*Attorney, Agent, or Firm*—Antonelli, Terry & Wands

[57] ABSTRACT

A distribution type fuel injection pump for distributing and pumping a fuel into a plurality of cylinders of an internal combustion engine. The fuel injection pump is constructed of a hydraulic head formed with first and second fuel feed ports, a rotor fitted in the hydraulic head, and plungers fitted in the end portion of the rotor for effecting the pumping action in accordance with the rotations of the rotor. Separately of this rotor, there is formed in the hydraulic head, for example, a pressure space in which a shuttle is slidably fitted to partition the pressure chamber into first and second pressure chambers. The fuel, introduced from the first fuel feed port and compressed by the plungers, is guided into the first pressure chamber of said pressure space in accordance with the rotation of the rotor, and the fuel, is introduced into the second pressure chamber, is consecutively distributed and pumped into the respective engine chambers by the movements of the shuttle.

4 Claims, 2 Drawing Figures

DISTRIBUTION TYPE FUEL INJECTION PUMP

BACKGROUND OF THE INVENTION

1. Field of the Invention

The present invention relates to a distribution type fuel injection pump and, more particularly, to a distribution type fuel injection pump which can be electrically controlled and easily machined.

2. Description of the Prior Art

Generally speaking, a Diesel engine uses a fuel injection pump because it is necessary to feed a fuel under a high pressure to combustion chambers. The fuel injection pump of this kind is divided into straight and distribution types, but the latter type pump is mostly used in a small-sized high-speed Diesel engine since it is small in size and weight and has a reduced number of parts.

In some conventional distribution type fuel pumps, a rotatable drive rotor is fitted in a hydraulic head, and a pair of plungers, fitted in the rotor, effect the pumping action together with a cam ring disposed around the outer circumference of the rotor to thereby pump out the fuel which has been fed to a fuel feed bore formed in the center portion of the rotor. In this instance, the rotor is formed with radially extending distribution ports, and the same number of discharge ports as that of the engine cylinders are correspondingly formed in the inner circumference of the hydraulic head in a manner so as to extend in the circumferential direction so that the fuel is distributed in the injection order in accordance with the rotation of the rotor.

The fuel injection pump of the above-mentioned kind is equipped with a governor and an ignition advance device because it is necessary to properly control the injection rate of the fuel and the injection timing. The governor is used to maintain the fuel injection rate and the r.p.m. in a predetermined relationship not only during the normal running operation but also during a low-speed running operation and is operative to adjust the flow rate of the fuel, which has been fed to the rotor, in association with the operations of a control rack or a fly-weight by increasing or decreasing the effective area of a fuel passage. On the other hand, the ignition advance device is operative to adjust the rotation of a cam ring, which is operative to actuate plungers, in accordance with the balance between the fuel pressure and a spring to thereby adjust the operating timing of the plungers so that the ignition timing may be controlled.

However, the distribution type fuel injection pump thus far described has a problem in that its mechanism is complicated because the fuel injection rate and the injection timing are controlled by the mechanical components such as the governor or the ignition advance device. Moreover, if the number of the engine cylinders is increased or if the engine is speeded up, there arises another problem that the resultant high speed is difficult to follow by the mechanical construction so that a sufficient control cannot be performed. Therefore, it has been desired to provide a fuel injection pump which can be electrically controlled.

On the other hand, if an electromagnetic valve is used in the control system of the distribution type fuel injection pump, it is necessary to form the rotor with a control passage which uses the electromagnetic valve. As a result, still another problem is caused by the fact that the machining operation in high precision is concentrated at the rotor. More specifically, since the rotor acts not only as a high-speed rotating member but also a pressure chamber, there arises a further problem in that seizure takes place in the rotor in accordance with the rise in the temperature or the compression of the fuel.

SUMMARY OF THE INVENTION

It is, therefore, an object of the present invention to provide a distribution type fuel injection pump which avoids the aforementioned problems and which electrically controls the fuel injection rate and the injection timing and which can be easily machined to eliminate the fear of the rotor seizure accompanying the high compression.

In order to achieve the above-identified object, the distribution type fuel injection pump according to the present invention is equipped with such a shuttle mechanism, separate from a rotor, which is rotationally driven by a rotor-surrounding member such and a hydraulic head, as is composed of a shuttle and first and second pressure chambers partitioned by the shuttle. Moreover, the rotor is provided with a first inlet port which can communicate with both a distribution port formed in the rotor and the first pressure chamber. Likewise, the rotor is formed with both a booster passage, which is defined by a pair of plungers actuated by a cam ring disposed around the outer circumference of the rotor, and a second inlet port which can communicate with the second pressure chamber. The first and second inlet ports thus formed are arranged in radial directions and are provided in a number corresponding to that of the engine cylinders. On the other hand, the hydraulic head is formed with feed ports which can communicate with the first and second inlet ports, respectively, and which can be opened and closed by disposing electromagnetic valves therein.

With the construction thus far described, the distribution type fuel injection pump according to the present invention adjusts the time period, for which the electromagnetic valve of the feed port communicating with the first pressure chamber of the shuttle mechanism is opened and closed, to thereby control the fuel injection rate. On the other hand, the fuel injection pump of the present invention adjusts the time period, for which the electromagnetic valve of the feed port communicating with the second pressure chamber is opened and closed, to hold a balance in pressure between the first and second pressure chambers to thereby adjust the protrusions of the plugners so that the fuel injection timing can be controlled. Moreover, since the shuttle mechanism is constructed separately of the rotor, it becomes unnecessary to execute a new machining operation such as the formation of a pressure chamber in the center portion of the rotor. As a result, it is possible to obviate the problem of the rotor seizure which is caused by the expansion due to the fuel compression.

DESCRIPTION OF THE PREFERRED EMBODIMENT

Figure 1:
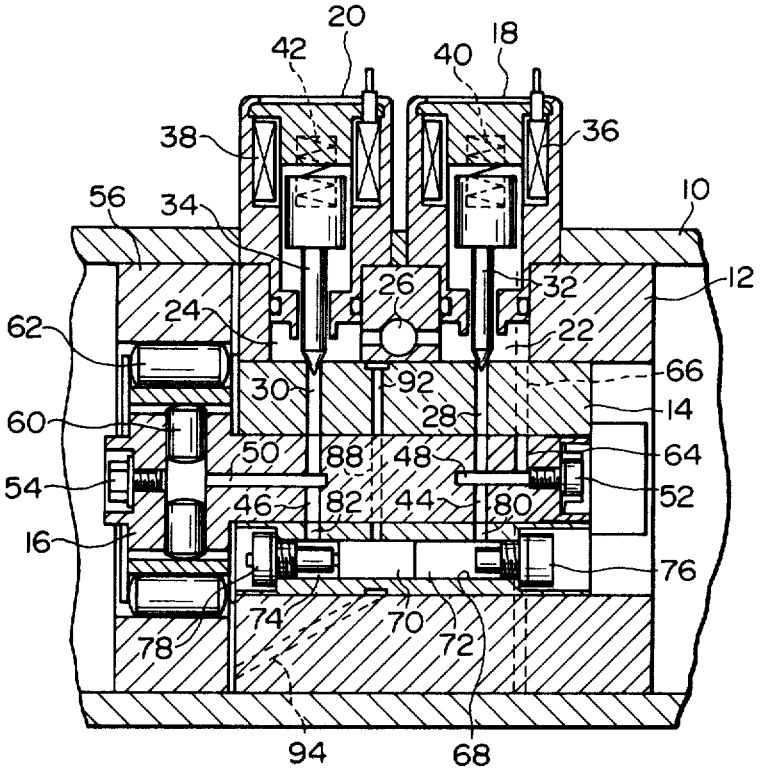
FIG. 1 is a cross sectional view showing the distribution type fuel injection pump constructed in accordance with the present invention.
Figure 2:
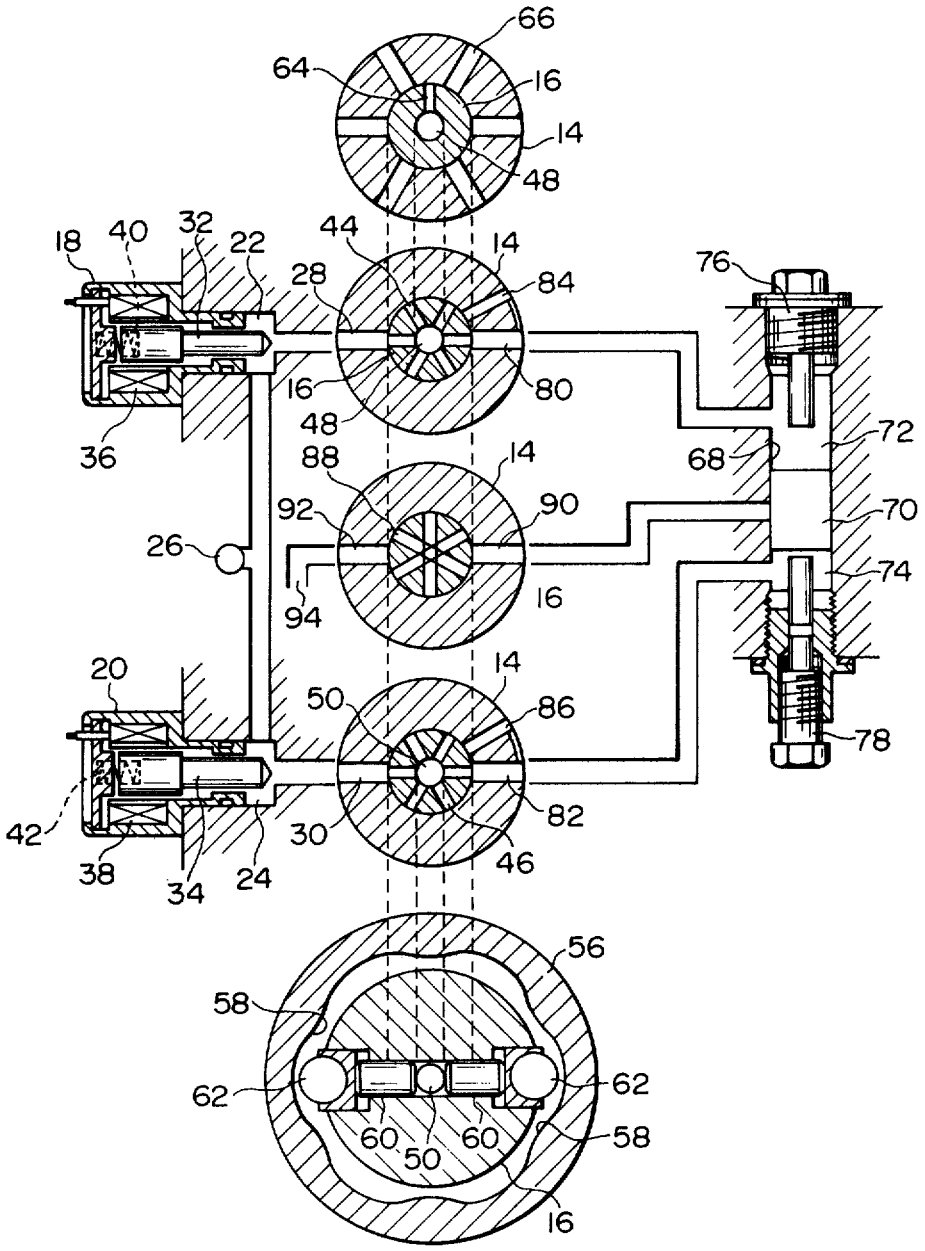
FIG. 2 is a partially schematic detail view of the fuel pump of FIG. 1 illustration a fuel flow.

As shown in FIGS. 1 and 2, the distribution type injection pump is equipped with a sleeve 12, which is fitted in a casing 10, and a hydraulic head 14 which, in turn, is fitted in the sleeve 12. The hydraulic head 14 has a rotor 16 fitted therein, with the rotor 16 being rotatably driven by an engine (not shown).

The sleeve 12 is formed with a pair of mounting holes for exposing the outer surface of the hydraulic head 14 to the outside. Those mounting holes are provided in one pair in the axial direction of the rotor 16 and respectively mount therein first and second electromagnetic valves 18 and 20. By these mounting operations of the electromagnetic valves 18 and 20, valve chambers 22 and 24 are defined in the mounting holes which in turn are defined by the outer end face of the head 14. Moreover, this head 14 is formed at its center portion between the two valve chambers 22 and 24 with a fuel feed passage 26 through which the fuel is fed out of a feed pump (not shown) and which is opened into the two valve chambers 22 and 24. As a result, the fuel is introduced through the feed passage 26 into the first and second valve chambers 22 and 24.

In these valve chambers 22 and 24, moreover, there are opened first and second feed ports 28 and 30 which are formed in the hydraulic head 14 and which have their respective openings opened and closed by the actions of the valve members 32 and 34 of the electromagnetic valves 18 and 20. These first and second electromagnetic valves 18 and 20 are of a normally closed type, in which the valve members 32 and 34 are moved by energizing coils 36 and 38 against the actions of springs 40 and 42 so that they establish communications between the valve chambers 22 and 24 and the feed ports 28 and 30 to thereby introduce the fuel into the feed ports 28 and 30. These first and second feed ports 28 and 30 are so directed toward the center axis of the rotor 16 that they are opened in the inner wall in which the rotor 16 is fitted.

The rotor 16 is formed with first and second inlet ports 44 and 46 which correspond to the first and second feed ports 28 and 30, respectively. Those inlet ports 44 and 46 form a plurality of radial passages, which are opened at an equal interval in the circumferential direction in the outer circumference of the rotor 16, and are provided in a number corresponding to that of the engine cylinders (i.e., six in the illustrated embodiment). As a result of the rotation of the rotor 16, intermittent communications are provided between the feed ports 28 and 30 of the head 14 and the inlet ports 44 and 46 of the rotor 16. Moreover, both the first and second inlet ports 44 and 46 are held in an angularly equal relationship with each other. As a result, when the first inlet port 44 and the first feed port 28 are in a communicating state, the second inlet port 46 and the second feed port 30 communicate with each other. Those first and second inlet ports 44 and 46 are made to communicate with the fuel feed and booster passages 48 and 50 which are formed independently of each other in the center axis of rotation of the rotor 16. Those passages 48 and 50 are formed to extend from both of the end faces of the rotor 16 and to have their open ends shut of by means of stop screws 52 and 54.

On the other hand, the rotor 16 is fitted in the hydraulic head 14, as described above, and its end portion at the side forming the booster passage 50 extending from the side of the head 14 to form a protrusion the outer surface of which is covered with a cam ring 56. This cam ring 56 is fitted in the casing 10 adjacent to the sleeve 12 and has its inner circumference formed with undulating cam lands 58. These cam lands 58 are equidistantly spaced in the circumferential direction and in an equal number to that of the engine cylinders. In the rotor 16 facing the cam ring 56, there are disposed a pair of plungers 60 which are fitted in a hole formed in the diametrical direction of the rotor 16. On the leading ends of the plungers 60, there are mounted cam rollers 62 which can come into sliding contact with the cam lands 58 of the cam ring 56. The plungers 60 are pushed into the rotor 16 simultaneously as the cam rollers 62 abut against the cam lands 58 in accordance with the rotation of the rotor 16. The space in the rotor 16, defined by the plungers 60, communicate with the booster passage 50 so that the pumping action of the plungers 60 is applied to the inside of the booster passage 50. At the other end side of the rotor 16, i.e., at the end portion thereof with the fuel feed passage 48, there are radially formed distribution ports 64 which have communication with the fuel feed passage 48. Those distribution ports 64 are opened in the inner circumference of the hydraulic head 14, and discharge ports 66 capable of communicating with the distribution ports 64 are so formed in the inner circumference of the head 14 so as to correspond to the openings of the distribution ports 64. Those distribution ports 66 are radially formed in the head 14 and are arranged equi-angularly in an equal number to that of the engine cylinders. The discharge and distribution ports 66 and 64 thus formed are allowed to communicate with each other when the first and second feed ports 28 and 30 are blocked from the first and second inlet ports 44 and 46. More specifically, the distribution ports 64 are arranged in positions which are shifted a half angle between the inlet ports 44 and 46. The discharge ports 66 are allowed to communicate with the respective combustion chambers of the engine through delivery valves.

On the other hand, the hydraulic head 14 or the member surrounding the outer circumference of the rotor 16 is equipped with a shuttle mechanism which is provided separately of the rotor 16. More specifically, the head 14 is formed with a pressure space 68 which extends in parallel with the axial direction of that rotor 16 and in which a shuttle 70 is slidably fitted. The shuttle 70 partitions the pressure space 68 into a first pressure chamber 72 and a second pressure chamber 74 to thereby change the capacities of the pressure chambers 72 and 74 when it is moved. These first and second pressure chambers 72 and 74 are closed by means of bolts, which are screwed from both the end faces of the head 14, such that the first pressure chamber 72 is shut off by a stopper bolt 76, whereas, the second pressure chamber 74 is shut off by an adjusting bolt 78. This adjusting bolt 78 is used to adjust the displacement of the shuttle 70.

The first pressure chamber 72 of the shuttle mechanism is adapted to communicate with the first inlet port 44 of the rotor 16, and a communication passage 80 therefor is formed on the same axis as that of the first feed port 28. Moreover, a communication passage 82 for providing communication between the second pressure chamber 74 and the second inlet port 46 is likewise formed on the same axis as that of the second feed port 30. Incidentally, the hydraulic head 14 is formed, as shown in FIG. 2, with auxiliary communication passages 84 and 86 which are arranged adjacent to the respective communication passages 80 and 82. Those auxiliary communication passages 84 and 86 are also formed in positions corresponding to one half of the angle between the inlet ports 44 and 46 and are connected with the communication passages 80 and 82, respectively.

Moreover, the rotor 16 is formed with radially extending spill ports 88 between the first and second inlet ports 44 and 46. The spill ports 88 are arranged to be shifted one half of the angle between the inlet ports 44 and 46. Each of the spill ports 88 is opened in the inner circumference of the hydraulic head 14 and can be connected with a pair of communication passages 90 and 92 which are formed in the hydraulic head 14. The communication passages 90 and 92 are arranged in diametrically opposite positions with respect to the rotor 16 such that the passage 90 is opened in the pressure chamber 68 of the shuttle mechanism, whereas, the other communication passage 92 is connected with a low-pressure passage 94 which is formed in the sleeve 12. That low-pressure passage 94 is opened in the casing 10. Incidentally, the communication passage 90 opened in the pressure chamber 68 is usually closed by the shuttle 70 and is connected with the second pressure chamber 74 when the shuttle 70 is moved toward the first inlet port 44.

The distribution type fuel injection pump thus constructed operates in the following manner. As shown in FIG. 1, when the rotor 16 is rotated one rotation so that the first inlet port 44 connects the first feed port 28 and the first pressure chamber 72, whereas, the second inlet port 46 connects the second feed port 30 and the second pressure chamber 74, the remaining distribution ports 64 and spill ports 88 are blocked. If, at this time, a valve opening signal is fed to the first electromagnetic valve 18, the fuel is fed to the first pressure chamber 72 so that the shuttle 70 is moved by the pressure in a direction to reduce the capacity of the second pressure chamber 74. This second pressure chamber and the passage connected with the former are filled up in advance with the fuel so that the fuel pumped out of the second pressure chamber 74 opens the plungers 60 after it flows through the second inlet port 46 and the booster passage 50.

If a valve opening signal is fed to the second electromagnetic valve 20, moreover, the fuel flows from the second feed port 30 into the second inlet port 46. This fuel enters the second pressure chamber 74 while further separating the plungers 60 apart from each other after it flows through the booster passage 50.

Next, when valve closing signals are fed to the first and second electromagnetic valves 18 and 20, the valve members 32 and 34 closes the first and second feed ports 28 and 30 to thereby finish the fuel feed to the first and second pressure chambers 72 and 74. The valve opening and closing signals are fed at the start and end of the fuel feeding operation and may be fed from the inside or outside of the injection pump.

When the rotor 16 rotates, moreover, the first pressure chamber 72 and the first feed port 28 are blocked, and the second pressure chamber 74 and the second feed port 30 are likewise blocked. Despite of this fact, the first and second inlet ports 44 and 46 are allowed to communicate with the first and second pressure chambers 72 and 74 through the auxiliary communication passages 84 and 86 so that the first and second pressure chambers 72 and 74 are allowed to communicate with the fuel feed passage 48 and the booster passage 50, respectively. At this time, communications are established between the distribution ports 64 and the discharge ports 66 and between the spill ports 88 and the communication passages 90 and 92.

While these port switching operations are being conducted, at the end portion of the rotor 16, the cam rollers 62 ride on the cam lands 58 of the cam ring 56 to push the plungers 60 inwardly to thereby boost the pressure of the fuel in the passage leading from the booster passage 50 to the second pressure chamber 74. The fuel under the high pressure thus built up moves the shuttle 70 to thereby apply a high pressure to the fuel in the passage leading from the first pressure chamber 72 to the fuel feed passage 48. As a result, the fuel at the first pressure chamber 72 flows out of the discharge ports 66 through the distribution ports 64 until it is injected into the combustion chambers through the delivery valves (not shown).

In the meanwhile, if the shuttle 70 continues to be moved by the fuel in the second pressure chamber 74 under the high pressure, the communication passage 90 communicating with the spill ports 88 is opened in the second pressure chamber 74 from the end face of the shuttle 70. Then, the fuel in the second pressure chamber 74 under the high pressure is released to the lower-pressure side by way of the spill ports 88. Simultaneously with this, the fuel prevailing in the passage leading from the first pressure chamber 72 to the fuel feed passage 48 also has its pressure reduced to terminate the fuel injections.

By repeating the operations thus far described, the pressure chambers draw in, compress and discharge the fuel coming from the first and second electromagnetic valves 18 and 20 so that the fuel is distributed in accordance with the fuel injection order.

Here, the fuel injection rate into the engine combustion chambers is determined by the quantity of the fuel fed from the first electromagnetic valve 18 to the first pressure chamber 72 so that it can be controlled by the open period of the first electromagnetic valve 18.

On the other hand, the adjustment of the injection timing can be performed by changing the contacting positions between the cam lands 58 of the fixed cam ring 56 and the cam rollers 62. This can be achieved by increasing or decreasing the fuel feed from the second electromagnetic valve 20 to thereby change the spacing between the plungers 60. As a result, the injection timing can be controlled by the fuel feed from the second electromagnetic valve 20, i.e., by the valve opening period.

Incidentally, since the auxiliary communication passages 84 and 86 communicate with the first and second inlet ports 44 and 46, communication can be established between the high voltage generating side and the discharge side while the fuel is being compressed or discharged, thus ensuring the pressure propagation, and the high pressure at that time can be prevented from being applied to the first and second electromagnetic valves 18 and 20.

Thus, the distribution type fuel injection pump according to the present embodiment electrically controls the fuel injection rate and the injection timing without requiring a large installation space as required by the mechanical control means of the prior art. Moreover, since the pressure space 68 is formed in the outer circumferential member of the rotor 16, other members are not adversely affected by deformation due to the pressure, temperature or the like. Furthermore, since the machining operation is not concentrated especially at the rotor, the fuel injection pump of the invention can be machined with remarkable ease. As a result, the pump can be reduced in size and weight.

Incidentally, although the shuttle mechanism is disposed in the hydraulic head 14 in the embodiment thus far described, it can be replaced by another member. In short, the the shuttle mechanism may be disposed in any member other than the rotor 16.

As has been described hereinbefore, according to the present invention, it is possible to provide a distribution type fuel injection pump in which the fuel injection rate and the injection timing can be adjusted by the electric control and which can be so remarkably easily machined as to eliminate the fear of the rotor seizure which might otherwise accompany the rise in the pressure to be applied to the fuel.

What is claimed is:

1. A distribution type fuel injection pump for distributing and pumping a fuel into a plurality of cylinders of an internal combustion engine through discharge ports, comprising:

hydraulic head means formed therein with a cylindrical space and with first and second fuel feed ports;

rotor means having one portion thereof rotatably fitted in the cylindrical space of said hydraulic head means and formed with first and second inlet ports which are arranged radially to correspond to said first and second fuel feed ports and which are provided in an equal number to that of the engine cylinders;

cam ring means formed therein with a space, in which another portion of said rotor means is rotatably fitted through at least one pair of plungers disposed therein in an end-to-end facing relationship, said plungers being operative to effect the pumping action in accordance with a rotation of said rotor means;

first and second electromagnetic valve means for electrically controlling the opening and closing operations of said first and second fuel feed ports; and pressure space means made separate from said rotor means and having an internal chamber which is partitioned into first and second pressure chambers by a shuttle slidable therein, wherein the fuel, which has been introduced through said first fuel feed port and compressed by said plungers, is guided into the first pressure chamber of said pressure space means in accordance with the rotation of said rotor means, and wherein the fuel which has been introduced into said second pressure chamber is consecutively distributed and pumped into the respective cylinders of said engine through said discharge ports by the movement of said shuttle.

2. A distribution type fuel pump as claimed in claim 1, wherein said pressure spece means is formed in said hydraulic head means.

3. A distribution type fuel pump as claimed in claim 2, wherein said pressure space means includes adjusting mechanism means for adjusting the displacement of said shuttle.

4. A distribution type fuel pump as claimed in claim 2, wherein said pressure space means is made integral with said hydraulic head means.

* * * * *